US011806600B2

(12) United States Patent
Kounellas et al.

(10) Patent No.: US 11,806,600 B2
(45) Date of Patent: Nov. 7, 2023

(54) INFRARED HOCKEY PUCK AND GOAL DETECTION SYSTEM

(71) Applicant: Glo-Flite LLC, Seattle, WA (US)

(72) Inventors: Jamilla Kounellas, Seattle, WA (US); Kevin Hay, Des Moines, WA (US); Paul Wierenga, Seattle, WA (US)

(73) Assignee: GLO-FLITE LLC, Seattle, WA (US)

( * ) Notice: Subject to any disclaimer, the term of this patent is extended or adjusted under 35 U.S.C. 154(b) by 142 days.

(21) Appl. No.: 17/476,202

(22) Filed: Sep. 15, 2021

(65) Prior Publication Data

US 2022/0001259 A1 Jan. 6, 2022

Related U.S. Application Data

(63) Continuation of application No. 16/864,116, filed on Apr. 30, 2020, now Pat. No. 11,161,027, which is a (Continued)

(51) Int. Cl.
*A63B 71/06* (2006.01)
*A63B 63/00* (2006.01)
(Continued)

(52) U.S. Cl.
CPC ..... *A63B 71/0605* (2013.01); *A63B 43/00* (2013.01); *A63B 63/004* (2013.01);
(Continued)

(58) Field of Classification Search
CPC ... A63B 71/0605; A63B 43/00; A63B 63/004; A63B 67/14; A63B 43/008;
(Continued)

(56) References Cited

U.S. PATENT DOCUMENTS 3,782,730 A 1/1974 Horchler
3,872,455 A 3/1975 Fuller et al.
(Continued)

FOREIGN PATENT DOCUMENTS

EP 1489572 A1 12/2004
EP 2085123 8/2009
(Continued)

*Primary Examiner* — Jeffrey S Vanderveen

(74) *Attorney, Agent, or Firm* — Lowe Graham Jones PLLC; Ellen M. Bierman

(57) ABSTRACT

Methods, systems, and techniques for automated detection of goals and announcement of same are provided. The system includes a modified hockey puck and a set of goal units that can be mounted on a hockey goal. Within the puck are light sources, motion sensors, infrared transmitters, and a power source. Within the goal units are light sources, infrared sensors, and a microcontroller. When the goal units are mounted on the hockey goal, the infrared sensors form a detection area through which the puck must pass in order to count as a goal. The infrared transmitter of the puck and the infrared sensors of the goal units communicate with one another, and, when an infrared signal is received, the microcontroller automatically triggers one or more annunciator devices, such as visual, auditory, or haptic devices, to automatically indicate that a goal has been scored without human intervention.

17 Claims, 10 Drawing Sheets

Related U.S. Application Data continuation-in-part of application No. 16/659,565, filed on Oct. 21, 2019, now Pat. No. 11,000,750, which is a continuation of application No. 15/966,594, filed on Apr. 30, 2018, now Pat. No. 10,507,374, which is a continuation-in-part of application No. 15/845,681, filed on Dec. 18, 2017, now Pat. No. 10,434,397, which is a continuation of application No. 14/323,026, filed on Jul. 3, 2014, now abandoned.

(60) Provisional application No. 61/842,495, filed on Jul. 3, 2013.

(51) Int. Cl.
*A63B 67/14* (2006.01)
*A63B 43/00* (2006.01)
*A63B 102/24* (2015.01)

(52) U.S. Cl.
CPC ..... *A63B 67/14* (2013.01); *A63B 43/008* (2013.01); *A63B 2102/24* (2015.10); *A63B 2220/803* (2013.01); *A63B 2220/805* (2013.01); *A63B 2220/833* (2013.01); *A63B 2225/15* (2013.01); *A63B 2225/30* (2013.01); *A63B 2225/54* (2013.01); *A63B 2225/74* (2020.08)

(58) Field of Classification Search
CPC ..... A63B 2102/24; A63B 2220/803; A63B 2220/805; A63B 2220/833; A63B 2225/15; A63B 2225/30; A63B 2225/54; A63B 2225/74; A63B 71/0669; A63B 2071/0625; A63B 2071/0655; A63B 2220/80; A63B 2225/50; A63B 2071/0694
See application file for complete search history.

(56) References Cited

U.S. PATENT DOCUMENTS

| | | | | |
|---|---|---|---|---|
| 4,064,528 | A | 12/1977 | Bowerman | |
| 4,375,289 | A | 3/1983 | Schmall et al. | |
| 4,968,036 | A | 11/1990 | Mark | |
| 5,564,698 | A | 10/1996 | Honey et al. | |
| 5,615,880 | A * | 4/1997 | Booth | A63B 24/0021 473/570 |
| 5,748,073 | A | 5/1998 | Crawford | |
| 5,816,947 | A * | 10/1998 | Kavitch | A63B 71/0669 273/374 |
| 5,947,846 | A * | 9/1999 | Craig | A63B 71/06 473/477 |
| 6,126,561 | A | 10/2000 | Mark | |
| 6,252,632 | B1 | 6/2001 | Cavallaro | |
| 6,972,787 | B1 | 12/2005 | Allen et al. | |
| 7,483,049 | B2 | 1/2009 | Aman et al. | |
| 7,867,113 | B2 | 1/2011 | Petersen | |
| 7,900,921 | B1 | 3/2011 | Palmer et al. | |
| 8,535,183 | B2 | 9/2013 | Eskildsen | |
| 2003/0210555 | A1 | 11/2003 | Cicero et al. | |
| 2005/0083201 | A1 | 4/2005 | Trosper | |
| 2005/0255787 | A1 | 11/2005 | Pak | |
| 2006/0267737 | A1 | 11/2006 | Colby | |
| 2007/0275801 | A1 | 11/2007 | Proulx et al. | |
| 2010/0222163 | A1 | 9/2010 | Eskildsen | |
| 2011/0237367 | A1 * | 9/2011 | Kodama | A63B 43/00 473/570 |
| 2012/0302301 | A1 * | 11/2012 | Homsi | A63B 24/0062 463/2 |
| 2014/0366650 | A1 * | 12/2014 | Thillainadarajah | G01L 1/26 73/862.625 |
| 2015/0011339 | A1 | 1/2015 | Kounellas | |
| 2016/0271447 | A1 * | 9/2016 | Cucco | H04W 4/80 |

FOREIGN PATENT DOCUMENTS

| | | |
|---|---|---|
| EP | 2085123 | 4/2012 |
| WO | 2007097752 | 8/2007 |

* cited by examiner

INFRARED HOCKEY PUCK AND GOAL DETECTION SYSTEM

CROSS REFERENCE TO RELATED APPLICATIONS

This application is a continuation of U.S. patent application Ser. No. 16/864,116 filed on Apr. 30, 2020; which is a continuation-in-part of U.S. patent application Ser. No. 16/659,565 filed on Oct. 21, 2019, now U.S. Pat. No. 11,000,750; which is a continuation of U.S. patent application Ser. No. 15/966,594 filed on Apr. 30, 2018, now U.S. Pat. No. 10,507,374; which is a continuation-in-part of U.S. patent application Ser. No. 15/845,681 filed on Dec. 18, 2017, now U.S. Pat. No. 10,434,397; which is a continuation of U.S. patent application Ser. No. 14/323,026 filed on Jul. 3, 2014; which claims the benefit of priority from U.S. Provisional Patent Application No. 61/842,495 filed on Jul. 3, 2013, the contents of which are incorporated herein by reference in their entireties.

TECHNICAL FIELD

The present disclosure relates to methods, techniques, and systems for goal detection systems. In particular, the present invention relates to a goal detection system including an infrared transmitting hockey puck and infrared sensing goal detection system configured to communicate with each other and other devices, in particular upon traversal of the hockey puck across a goal line of a hockey goal.

BACKGROUND

The sport of hockey is a fast-paced game played using hockey sticks and a single ball or puck, which is passed between players for the purpose of placing the ball or puck into a hockey goal. The speed of the players and the small size of the puck make it difficult for spectators and viewers to watch the game and recognize the location of the puck during gameplay. Visual cues from the players' movements are generally used to locate the puck, however when in proximity to the goal locating the puck becomes even more difficult. Moreover, determining when the puck has passed over the threshold of the goal can sometimes be difficult if there are several players around the goal.

When watching televised hockey games, locating the puck can be particularly difficult for viewers at home. Not only does this make it difficult to follow the game at times, but it can also lead to an overall decreased interest in the gameplay. Similarly, camera crews, referees, coaches, players, and goalies may also lose sight of the puck, particularly when in close proximity to the goal. This can be frustrating for all involved and is especially problematic for referees when calling scored goals. The current methods for determining when a goal is scored involves video replay. This technique is effective but can be hampered if the goalie or other players crowd the goal area and block the field of view of the camera within the goal. This makes determination of a scored goal impossible, particularly when many players are scrambling around the goal and the goalie is covering the puck.

SUMMARY

To alleviate these issues, the present disclosure contemplates an infrared transmitting hockey puck and an infrared sensing hockey goal detection system, wherein a specialized puck and hockey goal system are used to register when the puck has entered the goal. The hockey puck includes an infrared transmitter configured to transmit an infrared signal, while the goal detection system includes a light source and infrared sensors that form a sensing zone across the goal line or mouth of hockey goal when mounted thereon. The infrared sensors are configured to detect the infrared signal when the infrared signal traverses a sensing zone, i.e., the goal line of the hockey goal. In some embodiments, when the infrared signals are sensed, the light source is triggered, thereby automatically notifying viewers or users, fans, players, spectators, and referees of a goal. In some embodiments, when the infrared signals are sensed, a goal annunciator device is activated wirelessly and automatically.

The present disclosure describes an infrared hockey puck and goal detection system wherein the same can be utilized for providing convenience for the user when playing or viewing hockey.

The present disclosure describes a new and improved means of playing and viewing a game of hockey that has all of the advantages of the prior art and none of the disadvantages.

The present disclosure describes a hockey puck having an interior volume including multiple light sources, a motion sensor, a power source, and an infrared transmitter. Furthermore, the external housing of the hockey puck may be made from a vulcanized rubber.

The goal detection system makes efficient use of available energy in the hockey puck by including a passive mode and an active mode, wherein the hockey puck rests in the passive mode when inactive and transitions to the active mode when activated by motion.

The goal detection system can cause the light sources on the hockey puck to illuminate when in active mode.

The goal detection system is a mountable goal detection system that can be installed on most conventional hockey goals. The goal detection system including a top assembly, a left assembly, and a right assembly that are to be mounted onto the crossbar, left goal post and right goal post respectively. Altogether the assemblies include a plurality of light sources, infrared sensors, a power supply, and a microcontroller unit.

One or more light sources illuminate, or other local or remote annunciator devices including visual, auditory, or haptic devices, are triggered, upon detection the hockey puck passing over the goal line.

The goal detection system may operate using infrared, radiofrequency or other frequencies as appropriate

BRIEF DESCRIPTION OF THE DRAWINGS

Although the characteristic features of this disclosure will be particularly pointed out in the claims, the disclosure itself and manner in which it may be made and used may be better understood after a review of the following description, taken in connection with the accompanying drawings wherein like numeral annotations are provided throughout.

DETAILED DESCRIPTION

Figure 1:
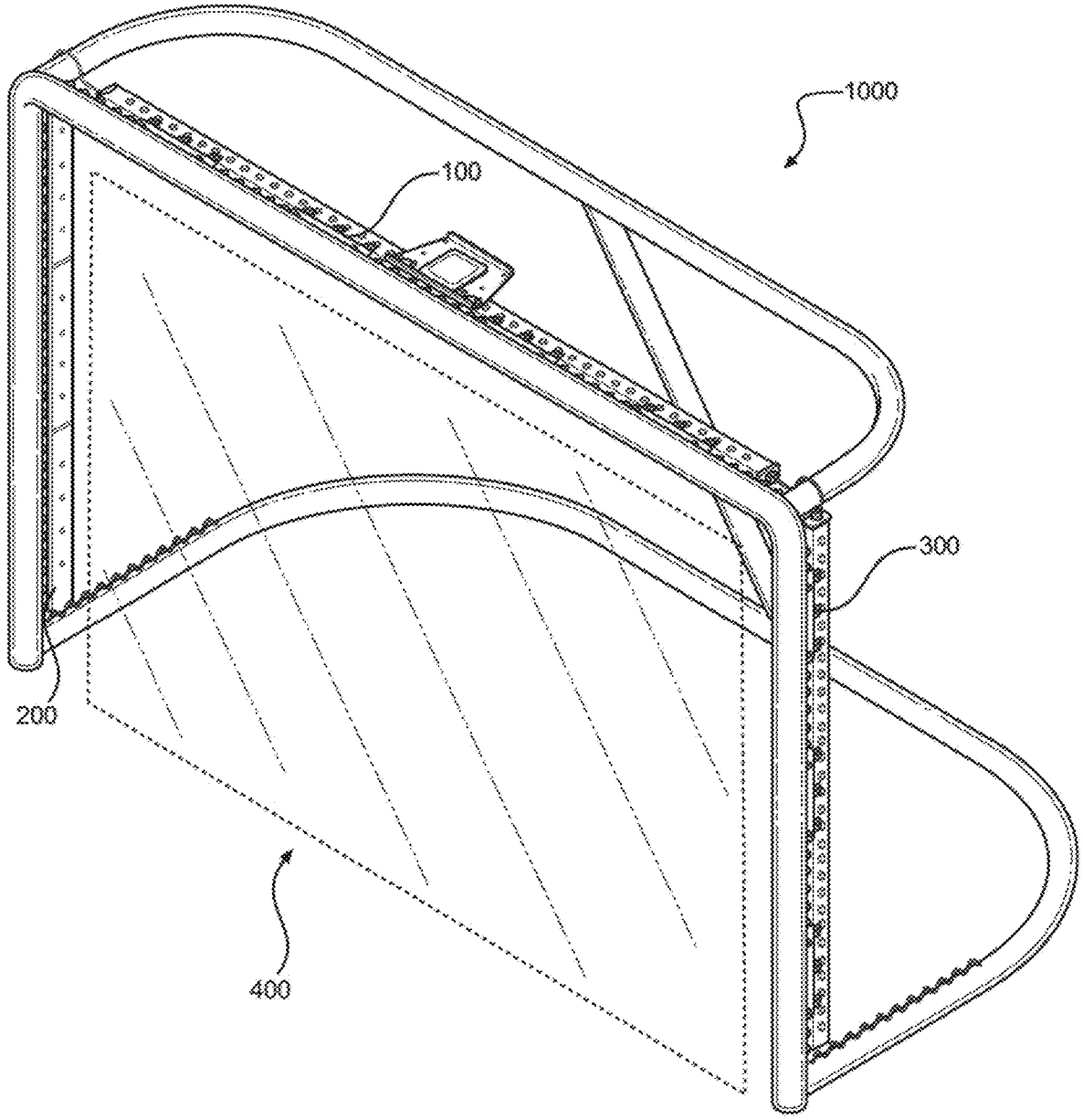
FIG. 1 shows a perspective view of a goal detection system.

Reference is made herein to the attached drawings. Like reference numerals are used throughout the drawings to depict like or similar elements of the infrared hockey puck and goal detection system. The figures are intended for representative purposes only and should not be considered to be limiting in any respect. The embodiments described may be operable together or separately and are examples of possible embodiments.

Referring now to FIG. 1, there is shown a perspective view of a goal detection system. The goal detection system 1000 comprises a top a top assembly 100, a left assembly 200, and a right assembly 300. In the illustrated example embodiment the top assembly 100 is configured to be mounted on the crossbar of a hockey goal, the left assembly 200 is configured to be mounted to the left goal post of a hockey goal, and the right assembly 300 is configured to be mounted to a right goal post of a hockey goal. Once mounted on a hockey goal, these three assembly elements combine with the surface on which the goal rests to define a sensing zone 400 that a hockey puck must pass through in order to be counted as a goal. In other embodiments the top assembly 100, left assembly 200, and right assembly 300 are attached to the hockey goal by means other than mounting, or perhaps could be built directly into the of the hockey goal and circumvent the need to mount entirely.

Figure 2A:
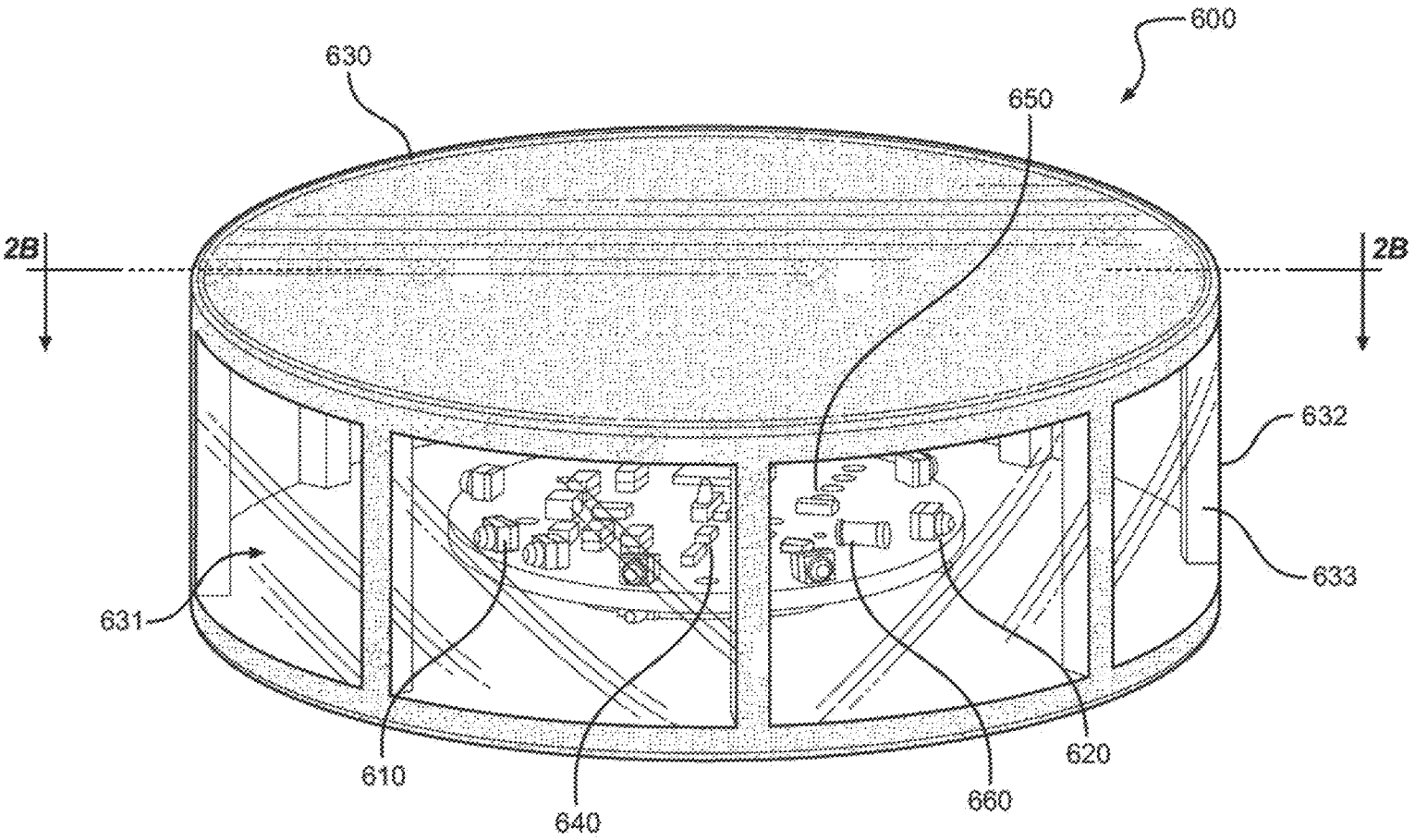
FIG. 2A shows a perspective view of a modified hockey puck.

Referring now to FIG. 2A there is shown a perspective view of a modified hockey puck. In the illustrated example embodiment, the modified hockey puck 600 comprises an ingress proof housing 630 having an interior volume 631. Encased within the housing 630 is a first light source 610, a second light source 620, a motion sensor 640, a battery 650, and an infrared transmitter 660. In the illustrated example embodiment, the modified hockey puck 600 is composed of vulcanized rubber and includes a sidewall 632 having transparent windows 633 to enhance visibility of the light sources 610 and 620 contained within. In other embodiments, the modified hockey puck 600 may be composed of other materials, and the transparent windows 633 in sidewall 632 may be configured differently. For example, instead of having multiple transparent windows 633 interlaced with frames carved out from sidewall 632, the window 633 is entirely comprised of a monolith transparent material that completely wraps around the circumference of the modified hockey puck 600. In other embodiments, instead of having the light sources 610 and 620 encased within the housing 630, the light sources are embedded directly into sidewall 632, such that irrespective of sidewall's 632 configuration light sources 610 and 620 would remain visible to players and a viewing audience.

In the illustrated example embodiment, the modified hockey puck 600 further includes two modes of operation to reduce power consumption and improve overall performance of the hockey system: (i) a passive mode and (ii) an active mode. In the passive mode the modified hockey puck 600 rests in an ultra-low energy consumption state such that only the motion sensor 640 remains active while the first light source 610, second light source 620, and infrared transmitter 660 are all inactive. The modified hockey puck 600 transitions from the passive mode to the active mode upon detection of motion by the motion sensor 640. Once in the active mode the first light source 610 is illuminated, and the infrared transmitter 660 begins transmission of an infrared signal.

In the illustrated example embodiment, the motion sensor 640 comprises a shock sensor that is configured to detect a shock signal value change in response to motion of the modified hockey puck 600. More specifically, the active mode is triggered upon detection of a shock signal value above a predefined threshold. Also, the modified hockey puck 600 is configured to transition from the active mode to the passive mode when the shock sensor has not detected a shock signal value over the threshold value for a predetermined amount of time. In other embodiments the motion sensor may be configured to detect motion of the modified puck 600 by other means.

Figure 2B:
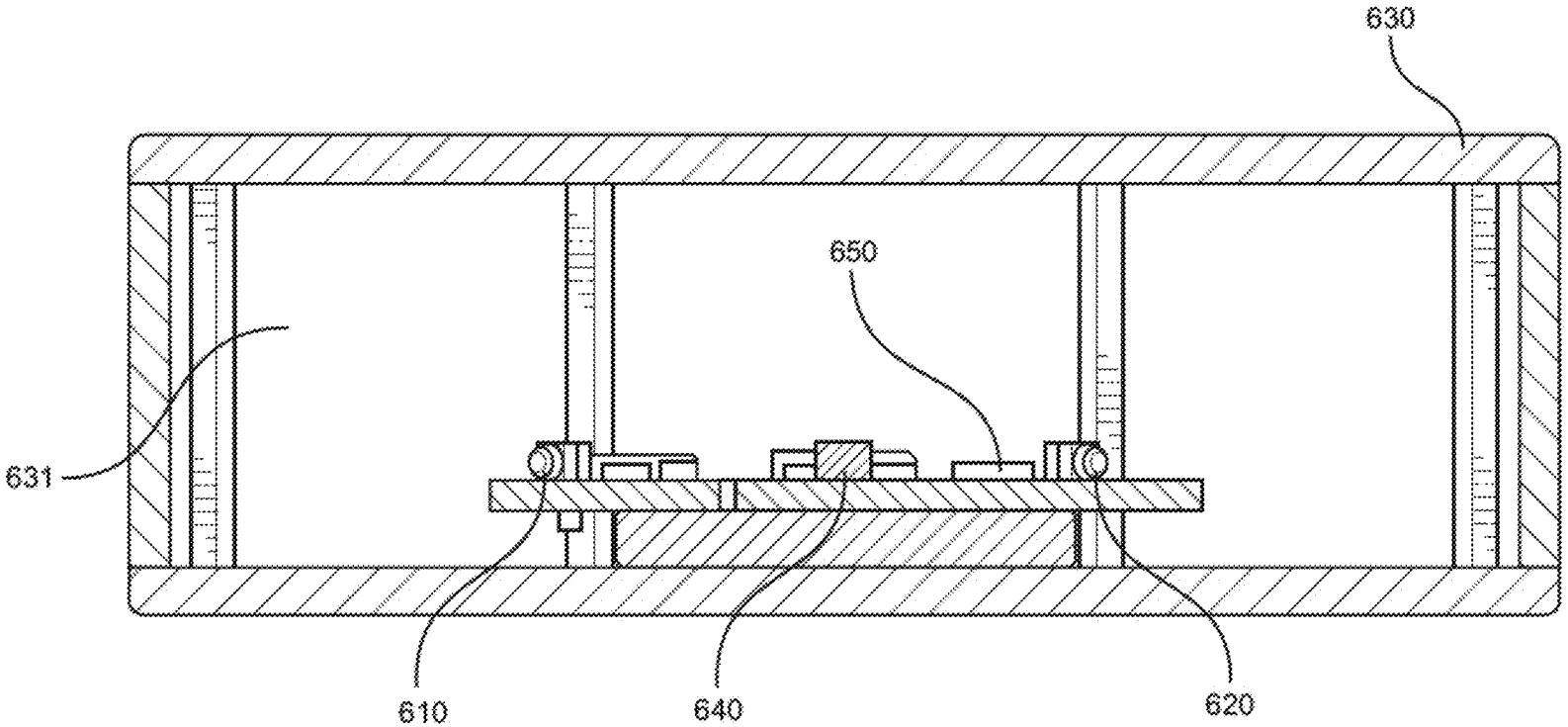
FIG. 2B shows a cross-section of the modified hockey puck along line 2B.

Referring now to FIG. 2B there is shown a cross-section of the modified hockey puck along line 2B. The second light source 620 is activated when a voltage of the battery 650 drops below a predetermined uncharged threshold value in order to indicate that the battery 650 requires charging. More specifically, upon activation the second light source 620 is configured to flash intermittently such that the flashing will increase in frequency as the voltage of the battery 650 continues to decrease below the predetermined uncharged threshold value.

In the illustrated example embodiment, the battery 650 powering the modified hockey puck 600 includes an inductive receiver coil (not shown) that is configured to receive radiofrequency energy and to produce a charging voltage for charging the battery inductively or wirelessly. The battery 650 further includes a voltage regulator (not shown) for preventing overvoltage charging of the battery, such that the voltage regulator is activated when the voltage of the battery acquires a predetermined charged threshold value. Once the battery 650 has stored charge equivalent to the predetermined charge threshold value the second light source 620 is deactivated and the first light source 610 is activated to indicate that the battery 650 has finished charging. In other embodiments the modified hockey puck 600 may include other means of accumulating charge in a rechargeable battery or alternately the modified hockey puck 600 may include a different means supplying power such as disposable batteries.

Figure 3:
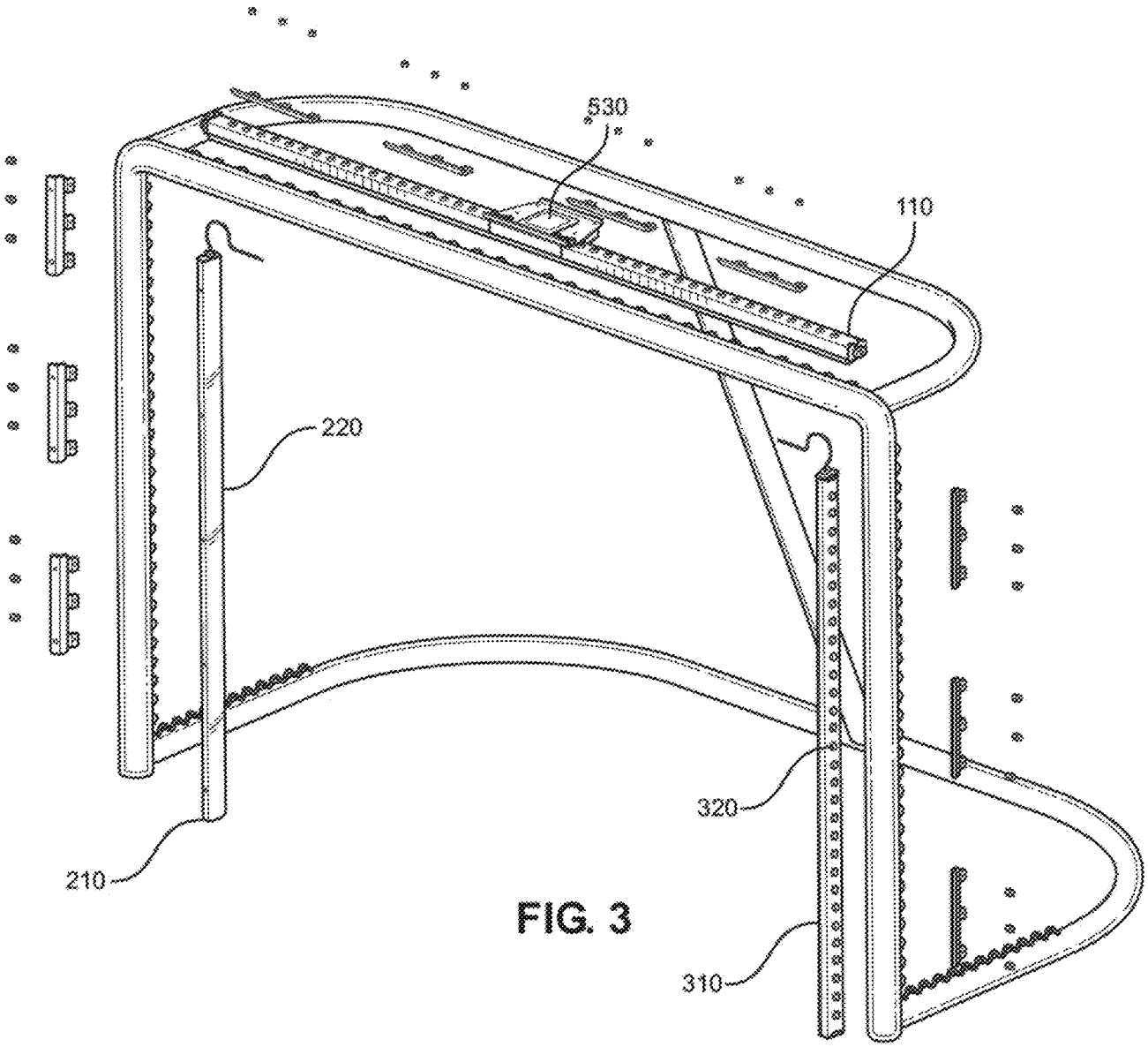
FIG. 3 shows an exploded view of a goal detection system.

Referring now to FIG. 3 there is shown an exploded view of a goal detection system. In the illustrated example embodiment, the top assembly 100 of the goal detection system 1000 comprises a microcontroller 530 and a third light source 110, the left assembly 200 comprises a fourth light source 210 and a first infrared sensor 220, and the right assembly 300 comprises a fifth light source 310 and a second infrared sensor 320.

In the illustrated example embodiment of the goal detection system 1000 the top assembly 100 is operably connected to the left assembly 200 and the right assembly 300, such that the first and second infrared sensors 220, 320 face the interior of the goal forming a sensing zone 400 (not shown) across a goal line of the hockey goal when mounted. Furthermore, the first infrared sensor 220 and the second infrared sensor 320 are configured to detect the infrared signal emitted by the infrared transmitter 660 (not shown) when modified hockey puck 600 (not shown) crosses the sensing zone 400. The microcontroller 530 is activated upon detection of the infrared signal crossing the sensing zone 400 by infrared sensors 220 and 320.

Consequentially, activation of microcontroller unit 530 then triggers activation of the third light source 110, the fourth light source 210, and the fifth light source 310 in order to indicate that a goal has been scored. More specifically, the goal detection system 1000 further comprises a comparator, such that any crossing of the infrared signal transmitter 660 across the sensing zone 400 will cause a voltage drop across the infrared sensors 220 and 320, which will in turn cause the comparator to drop below a predetermined sensing voltage threshold and activate the microcontroller unit 530.

In another example embodiment, instead of or in addition to the microcontroller unit 530 automatically activating one or more of the light sources 110, 210, or 310 to indicate a scored goal, the microcontroller unit 530 is configured to activate a wireless transmitter, which in turn activates an goal indication device, such as a goal indicator light, a siren, a bell, and/or a haptic device such as a vibration device. This capability may be useful to automatically control, for example, an existing goal announcing system without requiring a human (e.g., an official) to turn on the goal indicator light and/or horn. A common such existing system uses a red rotating light and/or a goal horn, which may be located behind glass at the end of the rink. The microcontroller unit 530 can automatically trigger indication/notification of a goal when the puck is sensed over the goal line without requiring human intervention. Automatic detection of a goal in conjunction with automatic announcement (indication, notification, etc.) of same frees officiants to pay closer attention to the game and increases the accuracy of goal announcement (by visual, auditory, or haptic means) relative to the actual goal event. In some embodiments, the goal announcement occurs nearly simultaneously and in near real time in that any delay in time from sensing the goal to goal announcement is not humanly perceptible.

Figure 7:
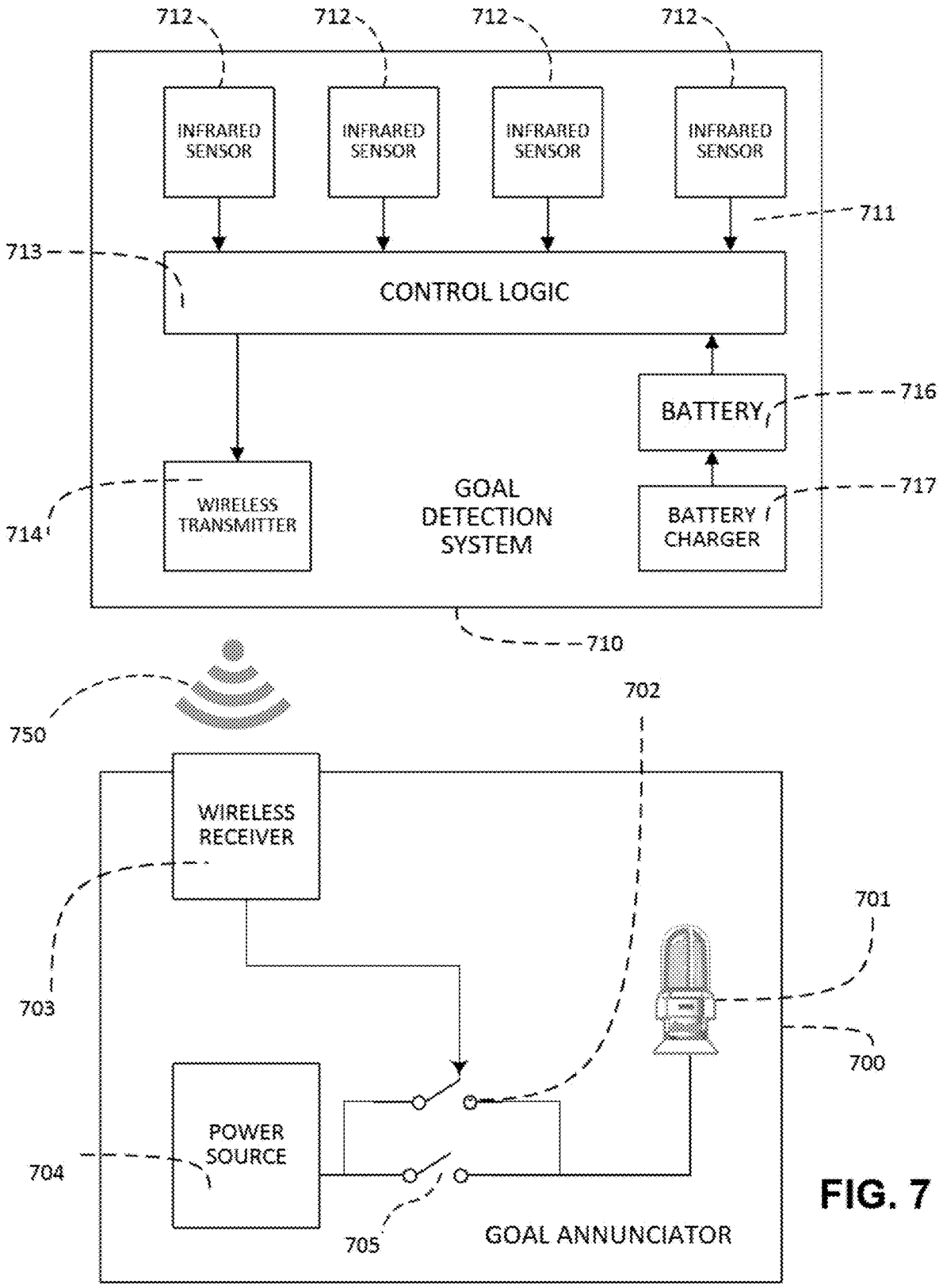
FIG. 7 shows an example block diagram of a goal detection system for triggering a remote goal annunciator.

As illustrated in FIG. 7, goal detection system 710 is configured to communicate with a goal annunciator system 700 via wireless communication 750 through a wireless transmitter 714. Goal detection system 710 may be implemented in the same manner as goal detection system 1000 (FIG. 1), with additional components to wirelessly transmit information to external devices such as goal annunciator system 700. Goal detection system 710 includes one or more infrared sensors 712 which communicate through digital signals 711 to control logic 713. These infrared sensors 712 may be the same sensors as infrared sensors 220 and 320, here shown to include any number. The control logic 713 may be executed by the microcontroller unit 530 or another microcontroller unit (not shown) mounted on the goal detection system 710 in a similar manner to that shown in FIG. 3. The microcontroller unit executes control logic 713 to cause wireless transmitter 714 to communicate wirelessly (750) to a wireless receiver (or transceiver) connected to a goal indication device.

The goal annunciator system 700 shown in FIG. 7 is representative of any annunciator system capable of automatically triggering an existing goal indication device 701 external to the goal detection system 710, such as a red rotating light (device 701) and/or horn (not shown). The goal annunciator system 700 may also automatically trigger a goal indication device integral to the goal detection system 710 (it need not be remote). Instead of the goal indication device 701 being controlled manually by (a human which activates) an existing annunciator switch 705, the goal annunciator system 700 includes a wirelessly controlled relay switch 702 wired in parallel with existing switch 705 to control power from power source 704 to the goal indication device 701. Relay 702 and existing switch 705 are normally open and operate in parallel; thus, activating either switch allows energy to flow from the power source 704 to the goal indication device 701. The wireless receiver/transceiver 703 is electrically connected to the relay 702 to control power to the goal indication device 701. The relay switch 702 may be an electromechanical switch or a solid state device. As mentioned above, the goal indication device 701 may give visual, auditory, and/or haptic feedback.

To achieve automatic goal indication when the puck is sensed over the goal line, upon the infrared sensors 712 determining that a puck (such as modified hockey puck 600) has crossed the sensing zone 400, the control logic 713 (for example, executed by microcontroller 530) activates wireless transmitter 714. Wireless transmitter 714 then sends a wireless communication 750 to a wireless receiver/transceiver 703. Wireless communication 750 may be radio or optical wireless communication. Upon receiving the transmitted signal, the wireless receiver/transceiver 703 activates the goal indication device 701 by closing the relay switch 702, thereby connecting the goal indication device 701 to its power source 704.

Although described above with respect to infrared transmitters, other embodiments of goal detection system 1000 and modified hockey puck 600 employ radio frequency transmitters and receivers outside of the range infrared frequencies, or alternatively rely on a form of signal transmission and detection other than radio frequency technology.

Figure 4A:
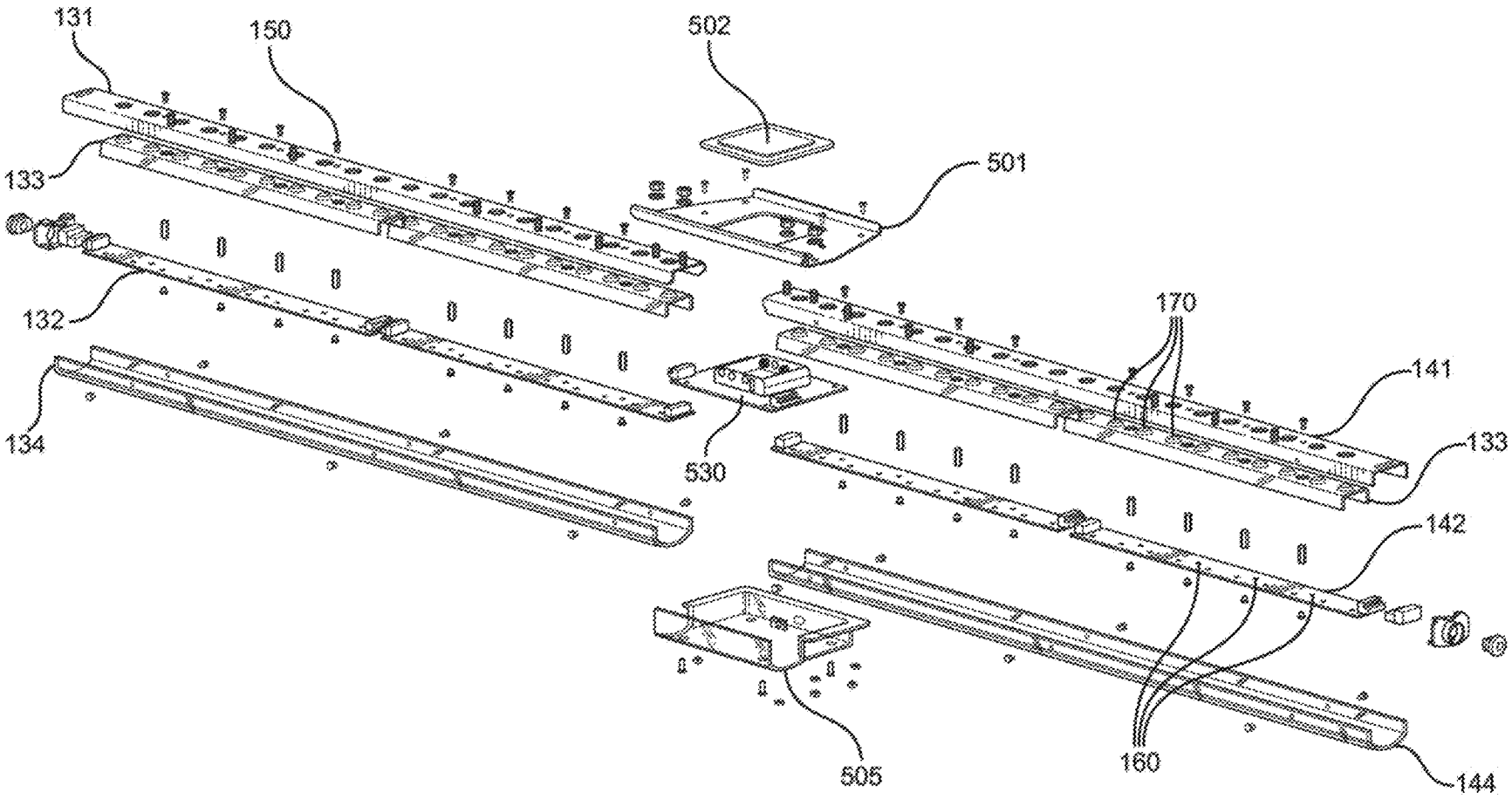
FIG. 4A shows an exploded view of a top assembly for the goal detection system.
Figure 4B:
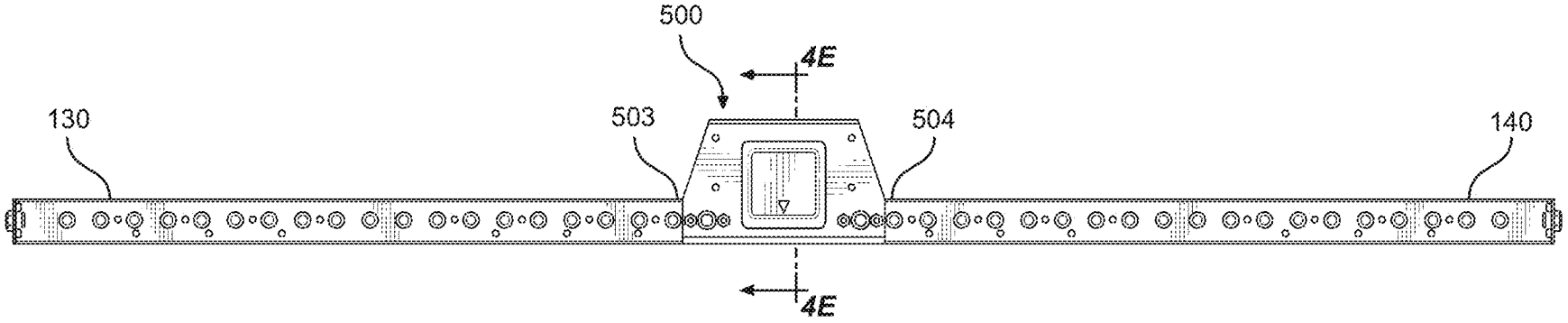
FIG. 4B shows a plan view of a top assembly for the goal detection system.
Figure 4C:
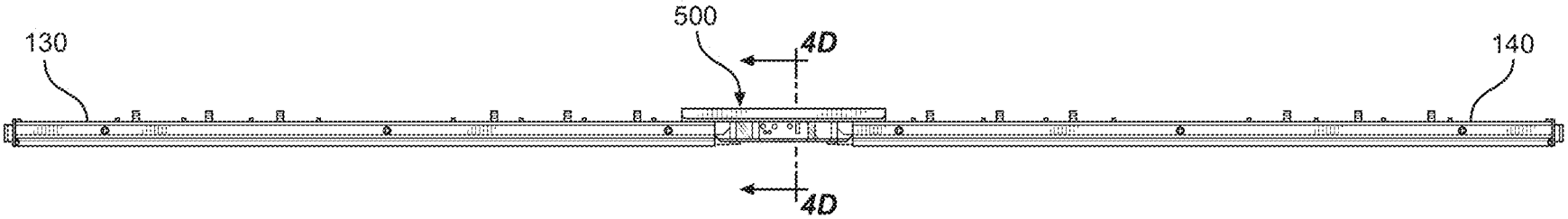
FIG. 4C shows a front view of a top assembly for the goal detection system.

Referring now to FIG. 4A there is shown an exploded view of a top assembly for the goal detection system. The top assembly 100 comprises a first unit 130 and a second unit 140 interconnected at a control box 500 (as seen in FIGS. 4B and 4C). In the illustrated example embodiment, the first unit 130 comprises a first mounting bracket 131, a first light board 132, a first light board cover 133, and a first mounting cover 134, such that the first light board cover 133 is mountably affixed to the first light board 132, the first mounting bracket 131 is mountably affixed to the first light board cover 133 and the first mounting cover 134 is mountably affixed to the first mounting bracket 131. Furthermore, the first light board 132 and the first light board cover 133 are positioned between the first mounting bracket 131 and the first mounting cover 134 in order to provide maximum protection for the potentially fragile electronic components on the first light board 132.

Similarly, the second unit 140 comprises a second mounting bracket 141, a second light board 142, a second light board cover 143, and a second mounting cover 144 such that the second light board cover 143 is mountably affixed to the second light board 142, the second mounting bracket 141 is mountably affixed to the second light board cover 143, the second mounting cover 144 is mountably affixed to the second mounting bracket 141. Furthermore, the second light board 142 and the second light board cover 143 are positioned between the second mounting bracket 141 and the second mounting cover 144 in order to provide maximum protection for the potentially fragile electronic components on the second light board.

Additionally, the first mounting bracket 131 and the second mounting bracket 141 each include a plurality of fasteners 150 extending outwardly therefrom, such that the plurality of fasteners 150 will secure each of the first 131 and second mounting brackets 141 to a portion of the crossbar of a hockey goal. Furthermore, the first light board 132 and the second light board 142 each include a plurality of LEDs 160 conjunctively defining the third light source 110. The first light board cover 133 and second light board cover 143 each include a plurality of transparent windows 170 corresponding to the plurality of LEDs 160, such that when the third light source 110 is activated the light emanated can more easily pass through the top assembly 100 and be visible to onlookers from a distance. Lastly, the control box 500 comprises a mounting plate 501, a battery cover 502, and a lower housing 505, such that the lower housing 505 houses a microcontroller 530, a power supply 510, and a power switch 520 operably coupled to the power supply 510. Other embodiments may be configured differently. For example, each unit 130 and 140 of top assembly 100 are configured to comprise more or less mounting elements, LEDs, electronic components to add functionality, optimize performance, or reduce production costs.

Referring now to FIGS. 4B and 4C, there are shown a plan view of a top assembly for the goal detection system and a front view of a top assembly for the goal detection system, respectively. In the illustrated example embodiment of the goal detecting system 1000, the first unit 130 is connected to a first side 503 of the control box 500 and the second unit 140 is connected to a second side 504 of the control box 500 altogether forming the top assembly 100, such that the control box 500 is positioned centrally there along. Other embodiments may be configured differently. For example, the top assembly 100 is not subdivided into two units 130 and 140 separated by the control box 500. Instead the top assembly could be a single unit to which the control box 500 is affixed by some other means.

Figure 4D:
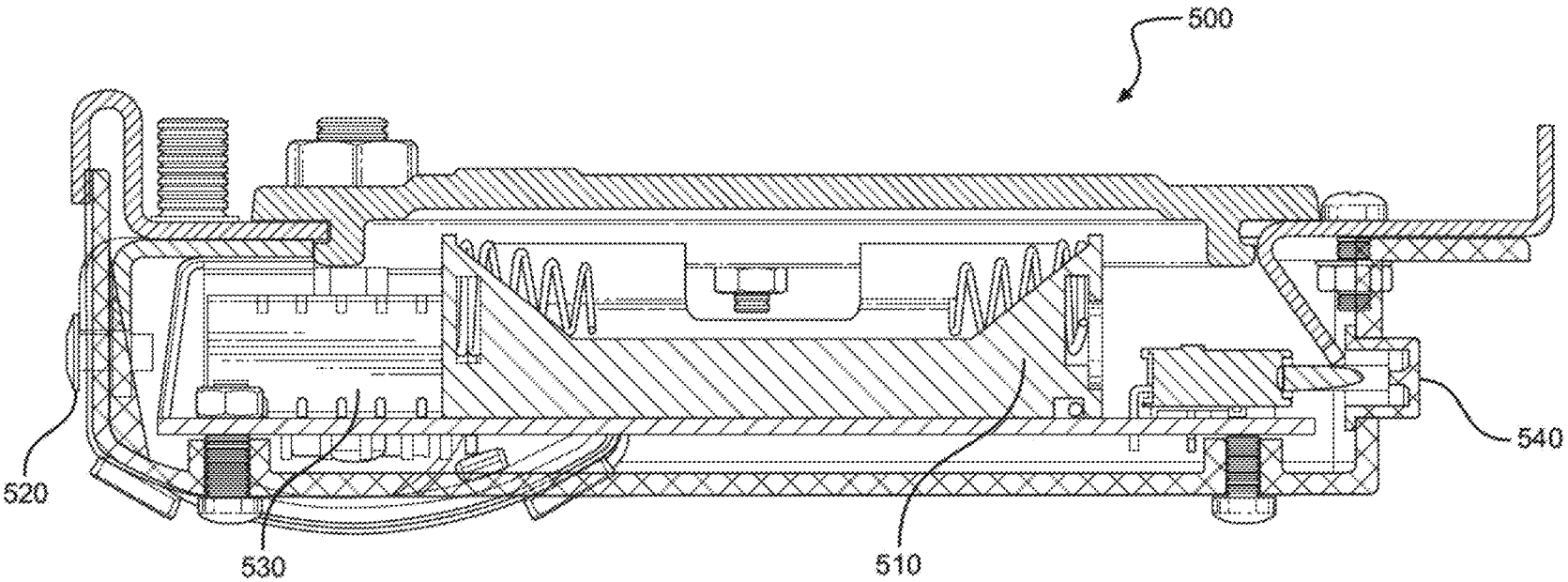
FIG. 4D shows a cross-section of a control box along line 4D.

Referring now to FIG. 4D there is shown a cross-section of a control box along line 4D. In the illustrated example embodiment, the control box 500 comprises a power supply 510, a power switch 520, a microcontroller unit 530, and a power indicator 540. In the illustrated example embodiment, the power supply 510 requires 4-AA batteries and outputs a 5V voltage to run the microcontroller 530 and to provide power to all electronic components contained in top assembly 100, left assembly 200, and right assembly 300. Additionally, the power indicator 540 comprises a red/green LED to display the operating condition of the device such that a green light will indicate adequate charge, and a red light will indicate that the batteries of power supply 510 will soon need to be replaced. In other embodiments the power supply 510 may use a rechargeable battery or output a different voltage. Furthermore, alternate embodiments provide additional functionality, such as an interface with a wireless controller so that light sources 620, 630, 110, 210, and 310 are enabled to mark the end of a period, or a manual override of light sources 620, 630, 110, 210, and 310 in the event of a bad goal call, or a trigger to a siren light.

Figure 5:
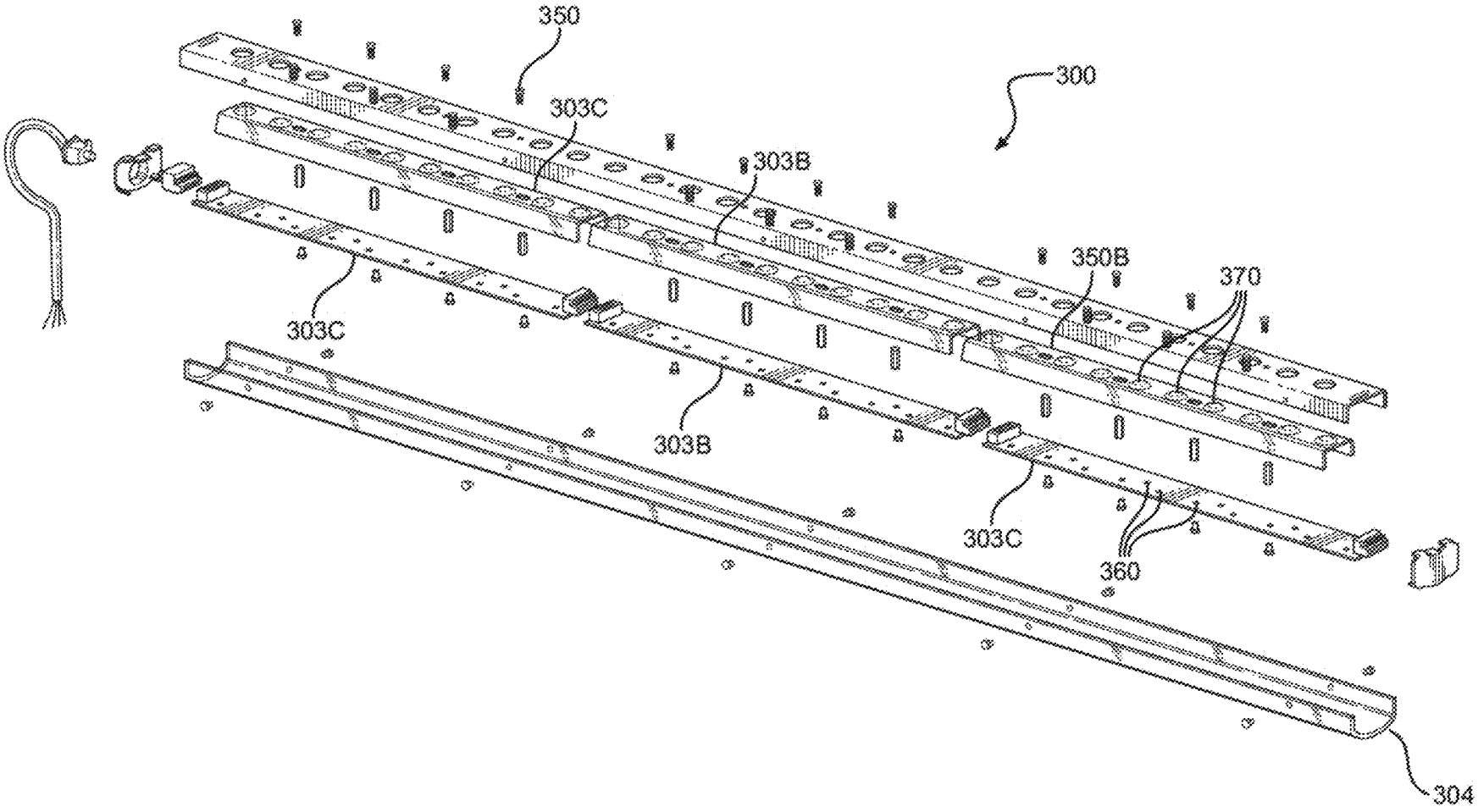
FIG. 5 shows an exploded view of a right assembly for the goal detection system.

Referring now to FIG. 5 there is shown an exploded view of a right assembly for the goal detection system. In the illustrated example embodiment the right assembly 300 comprises a fourth mounting bracket 301, a fourth light board 302, a fourth light board cover 303, and a fourth mounting cover 304, such that the fourth light board 302 and the fourth light board cover 303 are further sub-divided into three sections: a, b, and c. Furthermore, the sub-divisions 302*a*, 302*b*, and 302*c* of the fourth light board 302 are mountably affixed to the corresponding sub-divisions 303*a*, 303*b*, and 303*c* of the fourth light board cover 303. Further still the fourth mounting bracket 301 is mountably affixed to the fourth light board cover 303 and the fourth mounting cover 304 is mountably affixed to the fourth mounting bracket 301, such that the fourth light board 302 and the fourth light board cover 303 are positioned between the fourth mounting bracket 301 and the fourth mounting cover 304 in order to provide maximum protection for the potentially fragile electronic components on the fourth light board 302.

Additionally, the fourth mounting bracket 304 comprises a plurality of fasteners 350 extending outwardly therefrom in order to secure the fourth mounting bracket 304 to a right goal post of a hockey goal. The fourth light board 302 includes a plurality of LEDs 360 defining the fifth light source 310. The fourth light board cover 303 comprises a plurality of transparent windows 370 corresponding to the plurality of LEDs 360, such that when the fifth light source 310 is activated the light emanating therefrom can more easily pass through the right assembly 300 and be visible to onlookers from a distance. Other embodiments may be configured differently. For example, the right assembly 300 is configured to comprise more or less mounting elements, LEDs, electronic components, etc. to add functionality, optimize performance, or reduce production costs.

Figure 6:
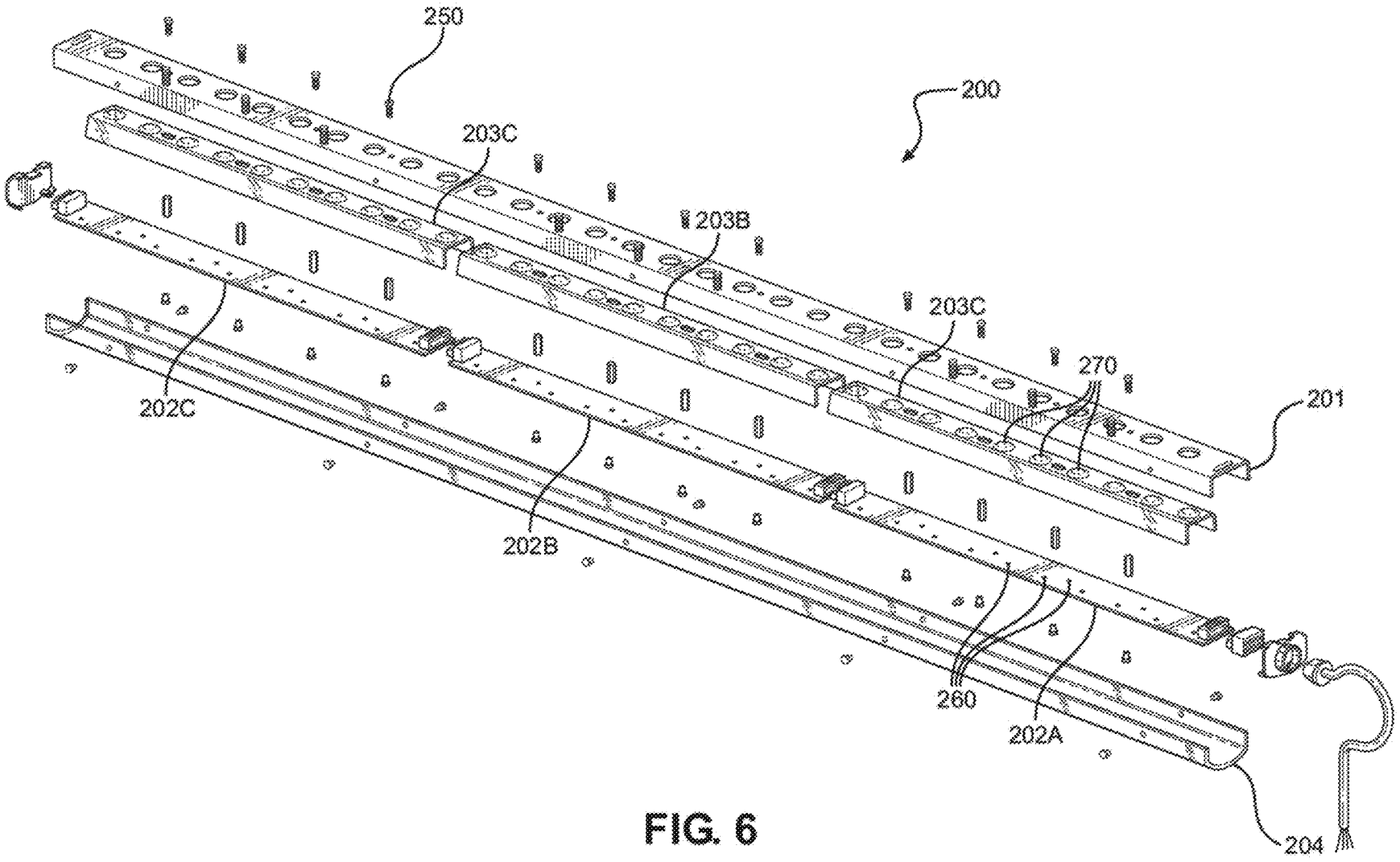
FIG. 6 shows an exploded view of a left assembly for the goal detection system.

Referring now to FIG. 6 there is shown an exploded view of a left assembly for the goal detection system. In the illustrated example embodiment the left assembly 200 comprises a third mounting bracket 201, a third light board 202, a third light board cover 203, and a third mounting cover 204, such that the third light board 202 and the third light board cover 203 are further sub-divided into three sections: a, b, and c. Furthermore, the sub-divisions 202*a*, 202*b*, and 202*c* of the third light board 202 are mountably affixed to the corresponding sub-divisions 203*a*, 203*b*, and 203*c* of the third light board cover 203. Further still the third mounting bracket 201 is mountably affixed to the third light board cover 203 and the third mounting cover 204 is mountably affixed to the third mounting bracket 201, such that the third light board 202 and the third light board cover 203 are positioned between the third mounting bracket 201 and the third mounting cover 204 in order to provide maximum protection for the potentially fragile electronic components on the third light board 202.

Additionally, the third mounting bracket 204 comprises a plurality of fasteners 250 extending outwardly therefrom in order to secure the third mounting bracket 204 to a left goal post of a hockey goal. The third light board 202 includes a plurality of LEDs 260 defining the fourth light source 210. The third light board cover 203 comprises a plurality of transparent windows 270 corresponding to the plurality of LEDs 260, such that when the third light source 210 is activated the light emanating therefrom can more easily pass through the top assembly 100 and be visible to onlookers from a distance. Other embodiments may be configured differently. For example, the left assembly 200 is configured to comprise more or less mounting elements, LEDs, electronic components, etc. to add functionality, optimize performance, or reduce production costs.

Referring again to FIG. 3 there is shown an exploded view of a goal detection system 1000. The goal detection system 1000, similar to the modified hockey puck 600, further includes two modes of operation to reduce power consumption and improve overall performance of the hockey system: (i) a passive mode and (ii) an active mode. In the passive mode the goal detection system 1000 rests in an ultra-low energy consumption state such that only the power indicator 540 of control box 500, and infrared sensors 220 and 320 of left assembly 200 and right assembly 300 remain active while the microcontroller unit 530 of control box 500, third light source 110 of top assembly 100, fourth light source 210 of left assembly 200, and fifth light source 310 of right assembly 300 are inactive.

The goal detection system 1000 transitions from the passive mode to the active mode upon detection of an infrared signal from the infrared transmitter 660 of modified hockey puck 600. In this embodiment, the light sources 110, 210, and 310 comprise addressable, multi-color LEDs 170, 270, and 370, such that when a goal is scored and the infrared signal from the infrared transmitter 660 is detected by the infrared sensors 220, 320, the microcontroller unit 530 will send a signal to light all of the LEDs to a solid red color enveloping the mouth of the hockey goal on all three sides for all players and spectators to recognize. Furthermore, the light sources 110, 210, and 310 employ a pulse width modulation (PWM) method that allows the LEDs 170, 270, and 370 to oscillate between on and off states at a frequency that is imperceptible to the human eye. Utilization of the PWM method will reduce power consumption and improve the overall performance of the hockey system. In other embodiments the light sources 110, 210, and 310 may employ a lighting technology other multicolor LEDs and may utilize a methodology other than PWM.

From the foregoing it will be appreciated that, although specific embodiments have been described herein for purposes of illustration, various modifications may be made without deviating from the spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The invention claimed is:

1. A hockey goal detection system, comprising:

an infrared goal detection system configured to be mounted onto a hockey goal, and comprising:

a microcontroller; and first and second infrared sensors operatively connected to the microcontroller and attached to goal posts of the hockey goal and configured to form a sensing zone across a goal line of the hockey goal when facing the interior of the goal and configured to automatically detect an infrared signal emitted from an infrared transmitter of a hockey puck when the hockey puck crosses the sensing zone; and wherein detection of the infrared signal across the sensing zone automatically activates the microcontroller without human intervention which in turn automatically activates a goal indication device through a wireless transmission such that a scored goal is indicated without human intervention in near real time, without human perceptible delay.

2. The hockey goal detection system of claim 1 wherein the goal indication device is a goal indication device physically external to the infrared goal detection system and to the hockey goal.

3. The hockey goal detection system of claim 2 wherein the automatic activation of the goal indication device through wireless transmission sends a wireless signal to a wireless receiver electrically connected through a relay to a power source configured to provide energy to the goal indication device.

4. The hockey goal detection system of claim 1 wherein the microcontroller comprises control logic that when executed causes the automatic activation of the goal indication device by causing the wireless signal to be sent to the wireless receiver.

5. The hockey goal detection system of claim 1 wherein the goal indication device is integrated in the infrared goal detection system.

6. The hockey goal detection system of claim 5 wherein the automatic activation of the goal indication device through wireless transmission sends a wireless signal to a wireless receiver electrically connected to a power source configured to provide energy to the goal indication device.

7. The hockey goal detection system of claim 1 wherein the goal indication device provides indication of a goal through visual, auditory, and/or haptic feedback.

8. The hockey goal detection system of claim 1 wherein the goal indication device is a siren light.

9. The hockey goal detection system of claim 1 wherein the goal indication device is a bell or a horn.

10. The hockey goal detection system of claim 1 wherein the goal indication device is an oscillating light that employs pulse width modulation to oscillate between on and off states and wherein the light is oscillated when the goal detection device is activated to signify the scored goal.

11. The hockey goal detection system of claim 1 wherein the goal indication device is a multicolor LED.

12. The hockey goal detection system of claim 1 wherein the goal indication device emits haptic feedback.

13. The hockey goal detection system of claim 1 wherein the wireless transmission is optical wireless transmission.

14. The hockey goal detection system of claim 1 wherein the wireless transmission is radiofrequency wireless transmission.

15. The hockey goal detection system of claim 1 wherein the infrared goal detection system comprises assembly units that are mounted onto an existing hockey goal such that the first infrared sensor is mounted via a left assembly unit to a left goal post and the second infrared sensor is mounted via a right assembly unit to a right goal post to form the sensing zone across the goal line when facing the interior of the goal and wherein the microcontroller is mounted to the left goal post, the right goal post, or a crossbar of the hockey goal.

16. The hockey goal detection system of claim 1 wherein the microcontroller of the infrared goal detection system is further configured to automatically trigger activation of at least one light source mounted onto the hockey goal when the hockey puck crosses the sensing zone providing notification of a scored goal.

17. The hockey goal detection system of claim 1 wherein first and second infrared sensors are configured to automatically detect an infrared signal emitted from an infrared transmitter of a hockey puck when the hockey puck crosses the sensing zone by sensing a voltage drop across at least one of the first and second infrared sensors, the voltage drop configured to cause a comparator to drop below a predetermined sensing voltage threshold thereby automatically activating the microcontroller unit.

* * * * *